United States Patent [19]

Petrick

[11] Patent Number: 4,800,727

[45] Date of Patent: Jan. 31, 1989

[54] ENERGY CONVERSION SYSTEM INVOLVING CHANGE IN THE DENSITY OF AN UPWARDLY MOVING LIQUID

[75] Inventor: Michael Petrick, Jolliet, Ill.

[73] Assignee: Solmecs Corporation N.V., Netherlands

[21] Appl. No.: 43,340

[22] Filed: Apr. 28, 1987

Related U.S. Application Data

[63] Continuation-in-part of Ser. No. 915,222, Oct. 2, 1986, abandoned.

[51] Int. Cl.[4] ..... F01K 25/04

[52] U.S. Cl. ..... 60/649; 60/673; 60/685; 60/688; 60/689; 310/11

[58] Field of Search ..... 60/649, 673, 685, 688, 60/689; 310/11

[56] References Cited

U.S. PATENT DOCUMENTS

| | | | |
|---|---|---|---|
| 3,443,129 | 5/1969 | Hammitt | 310/11 |
| 4,030,303 | 6/1977 | Kraus et al. | 60/670 |
| 4,041,710 | 8/1977 | Kraus et al. | 60/673 |
| 4,392,062 | 7/1983 | Bervig | 60/689 X |
| 4,571,534 | 2/1986 | Cover | 310/11 X |

*Primary Examiner*—Allen M. Ostrager

*Attorney, Agent, or Firm*—Leydig, Voit & Mayer

[57] ABSTRACT

A system for converting thermal energy into electrical energy includes a fluid reservoir, a relatively high boiling point fluid such as lead or a lead alloy within the reservoir, a downcomer defining a vertical fluid flow path communicating at its upper end with the reservoir and an upcomer defining a further vertical fluid flow path communicating at its upper end with the reservoir. A variable area nozzle of rectangular section may terminate the upper end of the upcomer and the lower end of the of the downcomer communicates with the lower end of the upcomer. A mixing chamber is located at the lower end portion of the upcomer and receives a second relatively low boiling point fluid such as air, the mixing chamber serving to introduce the low boiling point fluid into the upcomer so as to produce bubbles causing the resultant two-phase fluid to move at high velocity up the upcomer. Means are provided for introducing heat into the system preferably between the lower end of the downcomer and the lower end of the upcomer. Power generating means are associated with the one of the vertical fluid flow paths one such power generating means being a magneto hydrodynamic electrical generator.

7 Claims, 2 Drawing Sheets

ENERGY CONVERSION SYSTEM INVOLVING CHANGE IN THE DENSITY OF AN UPWARDLY MOVING LIQUID

This application is a continuation-in-part of Ser. No. 06/915,222, filed Oct. 2, 1986, now abandoned.

The present invention relates to systems for conversion of thermal energy into other energy forms, for example for the conversion of thermal energy from solar radiation, geothermal brine, and industrial waste heat; the invention is also applicable to more conventional higher grade heat sources such as those provided by nuclear and conventional fuels.

A conversion system using a vapour-liquid cycle is proposed in U.S. Pat. No. 3,443,129 (A. G. Hammit). This proposed system, however, suffers from several disadvantages which severely impair its practical usefulness. The system has a single, constant-diameter "common leg" or "bubble tube" 14, in which the liquid/vapour bubble mixture moves against a force field (gravitational or electromagnetic). This makes the system not only very tall (with all the structural problems involved) but, more important, very inefficient, for the following reasons. Assuming that the system works between reasonably different boiling and condensation temperatures, the rate of expansion of the vapour will be high. Thus, even if in the vicinity of the mixer 16 the void fraction (the ratio between vapour volume and the total liquid-plus-vapour volume) is low, it is bound to become very high in the middle and upper portion of the bubble tube 14 after the vapour expands to a large multiple of its original volume at the mixer. Now it can be shown that in such two-phase flows a high void fraction results in high slip (slip being the ratio between the flow velocity of the vapour bubbles and that of the liquid).

In a system in which the extraction of power is based on the pressure difference between the bubble tube 14 and the downflow tube 10, high slip inevitably results in low efficiency. Although, in principle, slip could be reduced by increasing flow velocity using a relatively narrow bubble tube, this would inevitably increase two other types of losses, namely acceleration losses (losses due to the energy expended in accelerating the liquid metal or other high-boiling point liquid along the bubble tube) and friction losses which are also a function of flow velocity. With this known system, the situation could be improved only by operating at very low two-phase-fluid quality (quality being the ratio between the mass flow rate of the gaseous phase and the mass flow rate of the liquid phase plus that of the gaseous phase). While this could be achieved by using a bubble tube of a substantially increased diameter, this would obviously cause the required amount of liquid-metal to become very large too, as a consequence of which specific power output, i.e., power produced per unit mass of the expensive liquid metal would be very low, increasing the cost, per unit power, of the system to a point where it would no longer be economically justifiable.

U.S. Pat. No. 4,392,062 to Bervig teaches the use of two fluids of widely disparate densities in a circuit which includes a vertical upcomer and a vertical downcomer provision being made for the inlet of the lower density fluid at the bottom end portion of the upcomer and for separating these fluids in a reservoir at the top of the upcomer and of the downcomer. Essentially Bervig is intended to store energy at off-peak electricity consumption periods by compressing air and releasing it to a mixing chamber at the bottom of the upcomer in order to provide lift to the working fluid by changing its density.

The mere addition of compressed air will not provide sufficient energy to give useful efficiency of power generation whether electrical or otherwise. Without the addition of heat acceptable efficiencies of power generation cannot be achieved. Moreover, in relation to certain operational aspects the proposal put forward by Bervig would not be viable since it is not possible readily to match output to actual requirements which is a substantial disadvantage if commercially acceptable efficiencies are to be achieved.

It is one of the objectives of the present invention to overcome the disadvantages and drawbacks of the prior art systems and to provide a system for energy conversion that is thermodynamically efficient, structurally flexible in that it can be relatively tall where height poses no problems, e.g., where it can be attached to already existing tall structures or relatively short wherever greater height would create difficulties, that for a comparable output uses much less liquid-metal than in prior-art systems, and is eminently cost-effective.

According to the present invention there is provided in a system for converting thermal energy into another form of energy, a reservoir, a relatively high-boiling point, low volatility, liquid within the reservoir, a downcomer defining a substantially vertically-extending flow path communicating at its upper end with liquid within the reservoir, an upcomer defining a further substantially vertically-extending flow path communicating with a space in the reservoir above the liquid level therein, means within the reservoir above the liquid level for substantially separating liquid and gas within the flow from said nozzle, a mixing chamber incorporated at a lower end portion of the upcomer, means for introducing through the mixing chamber a relatively low-boiling point fluid into the said liquid thereby producing bubbles in the liquid and hence a two-phase fluid of lower density than said liquid, and power-generating means operatively coupled with one of the substantially vertically-extending flow paths by means of which said other form of energy is made available by flow of the liquid down the downcomer.

Preferably the system includes means for introducing heat whereby further to increase the flow rate in the upcomer.

According to another aspect the invention provides in a system for conversion of thermal energy into another type of energy, a reservoir for a first, relatively high-boiling-point, low velocity, fluid, a downcomer defining a substantially vertically-extending flow path communicating at its upper end with said reservoir, an upcomer defining a substantially vertically extending flow path communicating at its upper end with said reservoir, a variable area nozzle through which the upcomer communicates with the reservoir, a plate separator mounted in the reservoir on which fluid discharged from the nozzle impinges, a diffuser mounted to receive fluid from the plate separator, a high-pressure vortex separator communicating with the outlet of the diffuser and with the upper end of the downcomer, said upcomer communicating at its lower end with the downcomer, a mixing chamber located at the lower end of said upcomer, through which mixing chamber a second, relatively low-boiling-point fluid is introduced into the upcomer for producing, upon contact with said first fluid, bubbles forming together with said first fluid a two-phase fluid having a lower density than said first fluid, heater means for introducing heat to the fluids of the system and power-generating means operated by fluid moving in one of said, vertically-extending flow paths by which means power is generated by said first fluid moving down said downcomer.

As is conventionally the case reference to the relatively low boiling point fluid is intended to include both vapours and gases.

DESCRIPTION OF THE PREFERRED EMBODIMENTS

Figure 1:
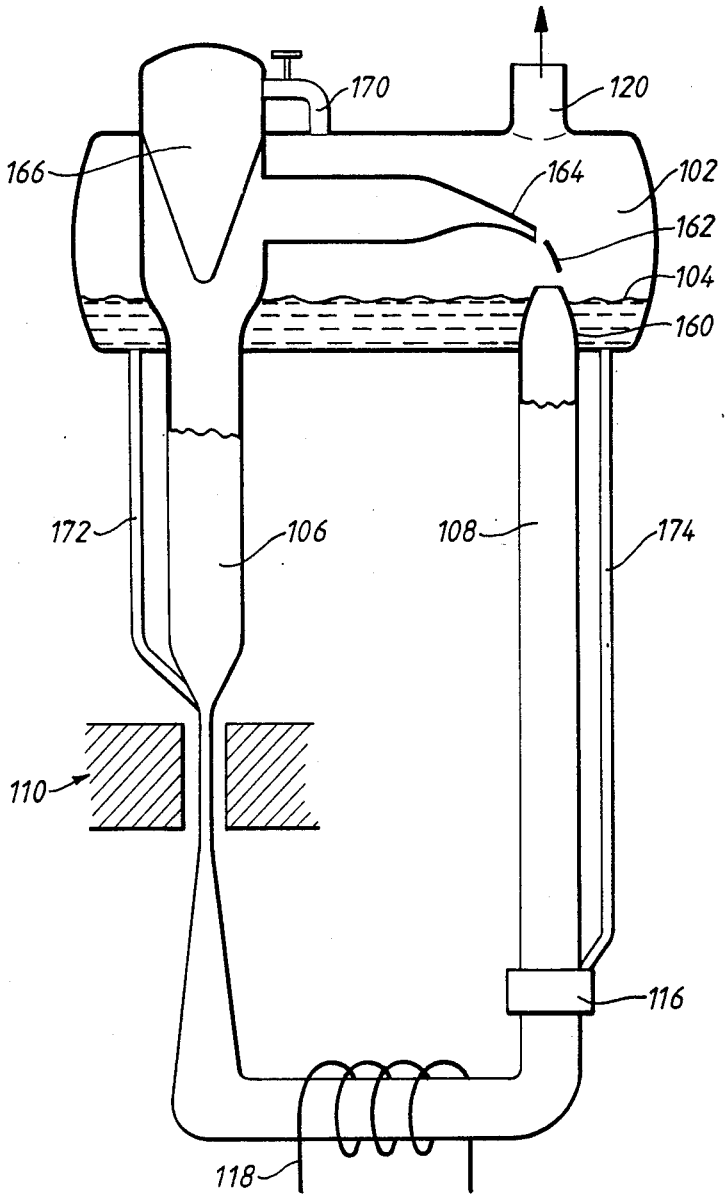
FIG. 1 is a diagram of the first embodiment of apparatus in accordance with the invention.

Referring now to FIG. 1 although described as a single stage plant, a multistage stage can also be employed.

The thermodynamic performance of systems as previously proposed for example in published patent application EP8400356 is high but in certain instances the thermodynamic performance is achieved only by features which are disadvantageous in certain instances from a commercial standpoint. These disadvantages including excessive system height, limiting the void volume fraction in the upcomer and increasing upcomer diameters with a view to reducing friction losses and keeping velocities sufficiently low to avoid high slip, as hereinbefore referred to. These disadvantages are liable to hinder economic viability of the corresponding systems.

It follows that economic considerations as opposed to thermodynamic ones require that the specific power (kW/kg) of liquid circulated and generator power density (kW/m3) must be maximized. One advantage of higher specific power is that the amount of costly, electrically-conductive, liquid such as lead or lead alloy is reduced and higher values of power density reduce the magnetic field volume where the final conversion of energy to electricity is achieved by a magneto-hydrodynamic generator.

Furthermore, the velocity of liquid flow should be as high as possible consistent with maintaining acceptable friction losses, particularly at bends at the top and bottom of the upcomer and downcomer. As will be appreciated from discussions set out hereinbefore, increasing upcomer velocity and void volume fraction increases appreciably the acceleration pressure drop in the upcomer and this loss becomes dominant in the system. Again, increase in the system height (both upcomer and downcomer) not only presents problems in accommodating the system as a whole and increases the pressure differential but increases the frictional losses and the amount of liquid required for operation. These difficulties may be overcome by both of the preferred embodiments of a system in accordance with the invention as illustrated in the two Figures.

Referring first to FIG. 1, a constant constant cross-section upcomer 108 terminates at its upper end in a convergent nozzle 160 of rectangular section the cross-sectional area being adjustable by means (not shown). Immediately above the nozzle which projects upwardly beyond the liquid level 104 in the reservoir 102 a plate (or primary) separator 162 is mounted transversely of the reservoir 102 and this serves partially to separate out the liquid, in general, lead from the relatively low boiling point fluid, such as Freon.

Upwardly, but downstream of the plate separator 162 liquid is collected and diffused to achieve a higher pressure in a diffuser 164 where, of course, the velocity is appreciably reduced at entry to a high pressure vortex separator 166 of conventional design.

The high pressure separator 166 leads directly to the downcomer 106 defining a substantially vertically-extending flow path communicating with the magneto hydrodynamic generator 110. The gas component separated off from the separator 166 is delivered to the upper part of the reservoir 102 through a valved connecting pipe 170.

Downstream of the magneto-hydrodynamic generator 110 the liquid circuit passes through heat input means 118 in the form of a heat exchanger and thence to a mixer 116 which lies in the lower portion of the upcomer 108. Gas is supplied at the mixer 116 and will normally be received, at least in part, from an outlet 120 in the upper part of the reservoir 102. As an alternative to heat input to the system through a heat-exchanger, heat input could be provided by supplying gas or vapour at a high temperature to the mixer 116.

Liquid from the body of liquid 104 in the bottom of the reservoir may be returned to the main flow at the bottom of the downcomer 106 immediately prior to entry to the MHD generator through a pipe or duct 172. Further liquid may be drawn off the body of liquid 104 and supplied to the mixer 116 at the bottom of the upcomer 108.

In operation the features of the described apparatus enable recovery of a major fraction of the kinetic energy of the liquid leaving the upcomer 108 and equally as importantly the pressure differential across the MHD generator 110 is increased but the quantity of costly liquid metal is reduced.

In more detail, the high velocity two phase liquid delivered to the upper end portion of the upcomer 108 which is generally of circular cross-section passes through a transition zone which leads to the rectangular section variable area convergent nozzle 160. The outlet of the nozzle is adjusted in dependence upon the variable flow parameters of the system.

The two phase fluid then impacts on the flat plate separator 162 so that a substantial proportion of the gaseous component immediately dissipates in the free space above the liquid level 104 within the reservoir 102. The plate 162 is so disposed that the liquid from which a substantial proportion of the gas has been removed enters the diffuser 164 where the velocity is reduced and the pressure increased and a duct leads the liquid to the high pressure vortex separator 166 where further gas is removed. The remainder of the gas ($<2$ wt%) is passed through the duct 170 to the gas space in the reservoir 102.

Thereafter the substantially gas-free liquid passes down the downcomer 106 where, when appropriate, it joins with liquid delivered through the pipe 172 at the inlet to the MHD generator which is of previously proposed form. Downstream of the power delivery stage heat is supplied, in general from a low grade source through the heat exchanger 118 and the reheated liquid then receives high pressure high-boiling point gas or vapour such as nitrogen or steam at the mixer 116. The addition of the gas causes a reduction in density in the two-phase fluid so that it is accelerated back to the top of the upcomer where it leaves through the adjustable nozzle 160.

In practice not all the liquid from the plate separator enters the diffuser 164 and the remainder (usually <5%) effectively by-passes the diffuser.

Liquid which is delivered through the pipe 172 can only do so for appropriate ratios of velocity of the inlet to the generator to the upcomer exit. These factors are primarily a question of MHD and upcomer design.

By recovering a major proportion of the kinetic energy of the two-phase fluid at the upcomer exit and providing an additional pressure drop across the convergent nozzle (thereby converting additional thermal energy to kinetic energy), the pressure drop across the generator is increased and hence also the specific power and also the power density. In practice there is an optimum cross-sectional area at the upcomer exit which will provide the best performance. Again, in practice, the optimum area of the nozzle will be dependent upon the losses arising at the surfaces of the various separators and also the efficiency of the diffuser. At start-up the variable area nozzle will normally be set at the maximum available open area.

When setting up the operating parameters the pressure in the separator 166 is adjusted to the desired level and as a consequence the area of the nozzle 160 will be reduced thus causing an increase in velocity. It follows that there will be an increase in kinetic energy at the outlet of the nozzle 164 which is converted to pressure at the top of the downcomer 106 after the liquid has passed through the diffuser/separator assembly and it follows that a higher pressure drop is generated across the MHD generator with consequent increase in power, power density, and specific power without at the same time increasing the height of the upcomer and downcomer or the quantity of high cost liquid within the system.

The nozzle, diffuser and separator system will enable the ratio of the system pressure differential to be varied to match specific requirements which will include balancing thermodynamic efficiency and the economics of the system as a whole. In one specific case by maintaining the exit area of the nozzle 160 equal to the cross-section of the upcomer 108 the kinetic energy of the liquid leaving the upcomer would be recovered and the overall thermodynamic performance increased. This is due to the fact that as hereinbefore referred to, the acceleration loss (kinetic energy) of the fluid at the upcomer exit, becomes the dominant loss. As the pressure drop is increased across the nozzle, the separator, and the diffuser sub-system relative to the pressure drop created by the density difference between the upcomer and downcomer, a point will be reached where the thermodynamic performance of the system of FIG. 1 will fall below that of the system of FIG. 1 of EP No. 8400356 but the latter will be much higher in order to create the same pressure differential across the generator. Thus, an advantage is achieved because the frictional and other fluid losses in the nozzle, separator, and diffuser system are generally higher than can be obtained with a system according to FIG. 1 of the prior EP publication. It follows that depending upon particular circumstances the system hereinbefore described can be designed for optimum thermodynamic or optimum economic performance. It should be noted that in the limit, where the height of the system is reduced to levels merely to facilitate start up, an entirely new liquid-metal MHD conversion system can be evolved which is based on the provision of the variable area convergent nozzle.

Although the MHD energy conversion system is preferred, the overall system can, alternatively, be replaced by a turbine/electric generator combination, or where shaft power only is required, a turbine alone.

As has hereinbefore been described the embodiment of FIG. 1 relies on generation of power when the working fluid is in a single phase condition. The embodiment of FIG. 2 relies for generation in a magneto-hydrodynamic generator which operates with two-phase working fluid and to enable this the generator is placed at the top of the upcomer defining a substantially vertical fluid flow path. Like parts to those of the embodiment of FIG. 1 will be given the same reference numerals but with the addition of a prime. For this reason it is not deemed necessary to describe in detail the individual component parts as these are, in themselves, identical to those of FIG. 1. The upcomer itself 108' does however differ in as far as there is a reduction of cross-section 109 immediately upstream of the generator 110' in order to accelerate the velocity of the two-phase working fluid. Correspondingly, in FIG. 2 the downcomer 106' is maintained with a constant cross-section throughout its length. The manner of operation of this embodiment will now be described.

The basic system operates similarly to that of the embodiment of FIG. 1. Gas or vapour is injected into the mixer 116' where it joins with the liquid to create a two-phase mixture. The pressure of the gas or mixture in the upcomer 108' immediate creates a two-phase fluid of which the density is less than the liquid in the downcomer 106' and this generates a pressure differential with consequential fluid circulation throughout the system. In practice, the flow parameters (gas to liquid flow rates) are adjusted so that the inlet void fraction of the flow entering the MHD generator 110' is compatable with the desired pressure drop (power output) across the MHD generator and a limiting generator exit void fraction which is, in general, but not essentially, maintained to be less than 0.85.

The alternative provided by the system of FIG. 2 in which the MHD generator operates with a two-phase fluid disposed at the top of the upcomer 108' leads to an improvement of performance beyond that of the FIG. 1 system as follows:

1. The void volume fraction of the two-phase flow increases and becomes a maximum as the mixture flows upwards through the upper portion of the upcomer 108' of reduced cross-section at 109 and thence into the separator 162. It follows that in this region the slip ratio (the velocity ratio of the gas to that of the liquid) would increase owing to the lower pressure and higher void fraction and consequential loss in thermodynamic efficiency. However, the location of the MHD generator 110 in this zone mitigates the problem since when the two phase flow passing through the generator interacts with the magnetic field the slip ratio is rapidly reduced to approximately unity. This fact has been established by extensive laboratory testing and it can therefore be shown that the efficiency of circulation resultant from the density difference between the upcomer 108' and downcomer 106', is improved.

2. The location of the MHD generator 110 at the top of the upcomer 108 ensures that the volumetric flow through the generator is at a maximum which further improves performance. After leaving the MHD generator the two-phase fluid can either impact the separator surface 162 directly or, as in the FIG. 1 embodiment pass through a variable area nozzle. The latter arrangement serves to generate an even higher pressure differential across the system matched to particular conditions, thus increasing the specific power and power density in comparison with the non-variable nozzle 111 illustrated in FIG. 2.

Figure 2:
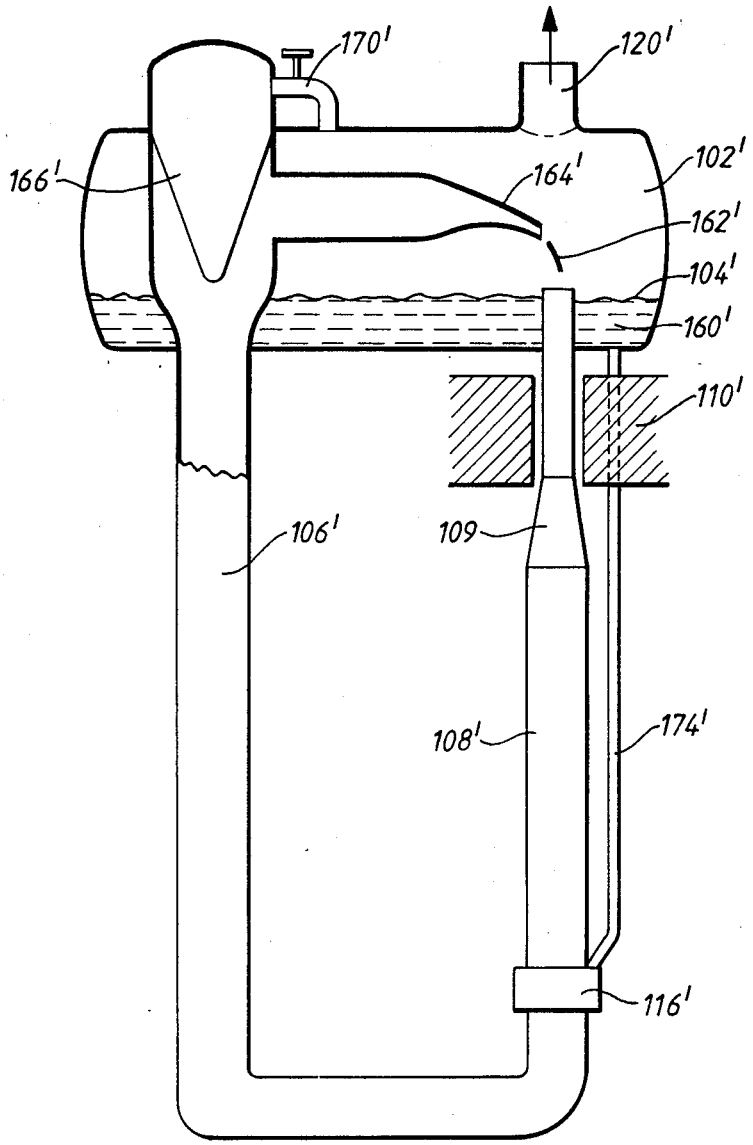
FIG. 2 is a diagram of a second embodiment of apparatus in accordance with the invention.

If various heat sources are incorporated in the system of either FIG. 1 or FIG. 2 it will be necessary to adjust heights of the component parts so as to adjust and thus match pressure differentials across each stage in correspondence with the actual flow parameters. No heat source is shown in FIG. 2 but can be located as in FIG. 1 and 118.

The following are the advantages of the hereinbefore described systems in comparison, primarily, with the system disclosed in EP No. 00356, FIG. 1:

(1) The systems herein described provide a means to (a) increase the specific power of the system;

(b) increase the power density of an MHD generator; and (c) reduce system liquid-metal inventory.

(2) Thermodynamic performance can be higher under certain conditions, than the system of FIG. 1 of EP No. 00356.

(3) Use of the convergent variable throat area nozzle is the key component that renders the systems hereinbefore described commercially feasible. The nozzle enables operation over a wide range of two-phase flows by-passing critical flow limitations while maintaining a high efficiency of conversion of pressure drop to kinetic energy.

(4) Because of the nozzle-separator-diffuser-Vortex separator subsystem, much better load following characteristics are possible.

(5) Total (or at least much superior) separation of gas (vapor) and liquid phases is achieved with the use of the flat plate and high pressure Vortex separators. This separation efficiency is crucial to obtaining the satisfactory performance of systems of the kind in question.

(6) Voids in the upcomer or riser can be controlled at higher values under conditions of low slip, thus improving the contribution of pressure drop from upcomer-downcomer density difference.

(7) Multistaging is more readily achieved and controlled with the herein described system.

(8) Economics greatly improved as volume and liquid metal inventory is reduced.

What is claimed is:

1. In a system for conversion of thermal energy into another type of energy, a reservoir for a first, relatively high-boiling-point, low velocity, fluid, a downcomer defining a vertical flow path communicating at its upper end with said reservoir, an upcomer defining a vertical fluid flow path, communicating at its upper end with said reservoir, a variable area nozzle through which fluid from the upcomer enters the reservoir, a plate separator mounted in the reservoir on which fluid discharged from the nozzle impinges, a diffuser mounted to receive fluid from the plate separator, a vortex separator communicating with the outlet of the diffuser and with the upper end of the downcomer, said upcomer communicating at its lower end with the downcomer, a mixing chamber located at the lower end of said upcomer, through which mixing chamber a second, relatively low-boiling-point fluid is introduced into the upcomer for producing, upon contact with said first fluid, bubbles forming together with said first fluid a two-phase fluid having a lower density than said first fluid, heater means for introducing heat to the fluids of the system and power-generating means operated by fluid moving in one of said vertical fluid flow paths by which means power is generated by said first fluid moving down said downcomer.

2. A system as claimed in claim 1, wherein said power-generating means is an MHD electrical power generator.

3. A system as claimed in claim 2 wherein said heater means serve to heat said first fluid to a temperature higher than the boiling point of said second fluid.

4. In a system for converting thermal energy into another type of energy, a reservoir, a first, relatively high-boiling-point, low volatility, fluid within the reservoir; a downcomer defining a substantially vertical flow path, communicating at its upper end with said reservoir; an upcomer defining a substantially vertical flow communicating at its upper end with said reservoir, said upcomer communicating at its lower end with the downcomer; a mixing chamber located at the lower end portion of the upcomer; means for introducing through said mixing chamber a second, relatively low-boiling-point fluid into the upcomer for producing, upon contact with said first fluid, bubbles forming together with said first fluid a two-phase fluid having a lower density than said first fluid; a variable area nozzle at the upper end of the upcomer through which fluid passes into the reservoir; means within the reservoir above the liquid level at the upper end of the upcomer for substantially separating liquid and gas within the fluid flow received from said nozzle; the separator means comprising a plate separator disposed immediately downstream of the nozzle and also a vortex separator disposed within the reservoir; and power-generating means operatively coupled with one of the vertical flow paths, by which means power is generated by said first fluid moving down said downcomer.

5. A system as claimed in claim 4 comprising ducting for passing liquid from the reservoir to the power generating means in parallel with the downcomer.

6. A system as claimed in claim 4 comprising means for supplying heat to the circulating system upstream of the upcomer, wherein the heat supplying means is a heat-exchanger disposed in the circuit between the lower end of the downcomer and the lower end of the upcomer.

7. A system as claimed in claim 4 comprising means for supplying heat to the circulatory system upstream of the upcomer, wherein the heat supplying means is combined with the low-density fluid inlet to the mixer by supplying the low density fluid at an elevated temperature.

* * * * *